United States Patent [19]

Meier

[11] 4,219,188

[45] Aug. 26, 1980

[54] SLIDE VALVE FOR THE INJECTION OF MATERIAL FOR USE IN THE OUTLET OF A METALLURGICAL VESSEL

[75] Inventor: Ernst Meier, Wolleraru, Switzerland

[73] Assignee: Stopinc Aktiengesellschaft, Zug, Switzerland

[21] Appl. No.: 66,464

[22] Filed: Aug. 13, 1979

[30] Foreign Application Priority Data

Aug. 19, 1978 [DE] Fed. Rep. of Germany ..... 2836409

[51] Int. Cl.[2] ..... B22D 37/00

[52] U.S. Cl. ..... 266/236; 222/600; 222/603; 266/220

[58] Field of Search ..... 266/220, 236; 222/600, 222/603

[56] References Cited

U.S. PATENT DOCUMENTS

| | | | |
|---|---|---|---|
| 3,581,948 | 6/1971 | Detalie | 222/600 X |
| 3,809,146 | 5/1974 | Andvzajak et al. | 222/600 X |
| 3,825,241 | 7/1974 | Shapland | 222/600 X |

FOREIGN PATENT DOCUMENTS

| | | |
|---|---|---|
| 1935401 | 12/1970 | Fed. Rep. of Germany . |
| 2404881 | 9/1974 | Fed. Rep. of Germany . |

*Primary Examiner*—M. J. Andrews
*Attorney, Agent, or Firm*—Wenderoth, Lind & Ponack

[57] ABSTRACT

A slide valve for the outlet of a metallurgical vessel includes a stationary plate having a flow-through opening and adapted to be fixedly positioned beneath an outlet in a metallurgical vessel, and a slide plate mounted beneath the stationary plate for sliding movement with respect thereto between plural positions, the slide plate having plural flow-through openings adapted to align with the flow-through opening of the stationary plate at respective of the plural positions of the slide plate. A nozzle support member is mounted beneath the slide plate and is movable therewith. A plurality of nozzle members having therethrough nozzle openings are selectively removably mounted on the nozzle support member for movement therewith at positions with each nozzle opening being aligned with a respective flow-through opening of the slide plate. The nozzle opening of at least a first nozzle member is free and unobstructed, thereby forming an outlet nozzle for the discharge of liquid melt. The nozzle opening of at least a second nozzle member has therein an injector device, thereby forming an injector nozzle for the injection of material therethrough and into the respective flow-through opening of the slide plate.

8 Claims, 2 Drawing Figures

SLIDE VALVE FOR THE INJECTION OF MATERIAL FOR USE IN THE OUTLET OF A METALLURGICAL VESSEL

BACKGROUND OF THE INVENTION

The present invention relates to an improved slide valve for the outlet of a metallurgical vessel and of the type including a stationary plate having a flow-through opening and fixedly positioned beneath an outlet in a metallurgical vessel and a slide plate mounted for sliding movement with respect to the stationary plate and having plural flow-through openings.

More particularly, the present invention is directed to such an improved slide valve whereby it is possible to inject gas, liquid and/or solid material into at least one flow-through opening in the slide valve and/or into the metallurgical vessel.

West German DT-OS No. 2,404,881 discloses a slide valve including a rotary slide plate having therethrough two flow-through openings. Outlet nozzles are attached to the slide plate adjacent each flow-through opening therein. Each outlet nozzle includes a refractory shell with a metal coupling sleeve therearound. The coupling sleeve has plug-type connections to enable coupling of the outlet nozzle to the metallic frame of the rotary slide plate. In this manner, it is possible to easily replace worn or corroded refractory shells. These readily replaceable outlet nozzles are also advantageous for maintaining the rate of outflow of a liquid melt from the metallurgical vessel constant without having to regulate the flow by means of adjusting movement of the slide plate. This is achieved by selectively replacing the outlet nozzles with new outflow nozzles having progressively increasing diameters as the level of liquid melt within the vessel decreases.

Additionally, West German DT-AS No. 1,935,401 discloses a slide valve including a slide plate having therein gas tubes or inlets for the injection of a gas to retard or prevent solidification of melt at the inlet of the slide valve or to produce a flushing operation of the melt.

SUMMARY OF THE INVENTION

With the above discussion in mind, it is the primary object of the present invention to provide an improved slide valve of the type including a slide plate having plural flow-through openings and wherein there are provided plural interchangeable nozzle members enabling both the discharge of liquid melt and the injection of gas, liquid and/or solid material.

This object is achieved in accordance with the present invention by the provision of a slide valve for the outlet of a metallurgical vessel, the slide valve including a refractory stationary plate having a flow-through opening and adapted to be fixedly positioned beneath an outlet in a metallurgical vessel, a refractory slide plate mounted beneath the stationary plate for sliding movement with respect thereto between plural positions, the slide plate having plural flow-through openings adapted to align with the flow-through opening of the stationary plate at respective of the plural positions of the slide plate, a nozzle support member mounted beneath the slide plate and movable therewith, a plurality of nozzle members having therethrough nozzle openings, the nozzle members being selectively removably mounted on the nozzle support member for movement therewith at positions with each nozzle opening being aligned with a respective flow-through opening of the slide plate. The nozzle opening of at least a first nozzle member is free and unobstructed, thereby forming an outlet nozzle for the discharge therethrough of liquid melt from the metallurgical vessel. The nozzle opening of at least a second nozzle member has therein an injector, thereby forming an injector nozzle for the injection of gas, liquid and/or solid material therethrough and into the respective flow-through opening of the slide plate.

The slide valve may be used in the manner conventional in the art, but when and if required, an injector nozzle may be attached to the nozzle support member to align with a selected flow-through opening in the slide plate. Gas may be injected through the injector nozzle to prevent solidification of the liquid melt or to achieve flushing of the liquid melt. Additionally, an injector nozzle may be selectively mounted adjacent a desired flow-through opening of the slide plate to inject therethrough gas, liquid and/or solid material to allow further or additional metallurgical processing of the melt.

Thus, in accordance with the present invention, the slide plate itself need not be specially constructed for supplying therethrough a gas. Therefore, the slide plate of the slide valve need be replaced only when wear conditions applying to the slide plate alone render such replacement necessary. On the other hand, the nozzle members, which are likely to wear more rapidly than the slide plate, can be independently replaced as necessary, dependent upon wear conditions applicable thereto alone. For example, an injector nozzle for the introduction of gas to prevent solidification of the melt can be replaced after each charging operation of the metallurgical vessel, while the slide plate itself may be continuously used through plural chargings of the vessel, since the slide plate in most conditions will be suitable and safe for use with plural chargings of the vessel, while the injector nozzle may be more rapidly worn and therefore need to be replaced at a greater frequency.

The injector nozzle employed according to the present invention is uncomplicated and easy to use for introducing fluxing, alloying and/or reagent materials into the melt. Thus, the slide valve of the present invention has broadly increased uses and advantages over and above the normal use as a slide valve.

Each nozzle member may include a refractory member having therethrough the respective nozzle opening, and a metal coupling sleeve surrounding the refractory member and adapted to be coupled to the nozzle support member. All of the nozzle members, both employed as outlet nozzles and as injector nozzles, may have identical exterior configurations. A metal lining may be provided to cover the exterior of the refractory member, with the metal sleeve surrounding the metal lining, thereby providing for better exchangeability and handling.

In accordance with one embodiment of the present invention, the injector nozzle comprises a gas-permeable refractory block filling the respective nozzle opening throughout the entire transverse cross-section thereof, and a gas supply connection connected to the refractory block. This arrangement allows the injection of a gas through the gas-permeable block and into the respective flow-through opening of the slide plate.

In accordance with a further feature of the present invention, particularly for the injection of liquid and/or solid material, the injector comprises a tube for the supply of liquid and/or solid material, the tube extending into the respective nozzle opening, and a mass cementing the tube within and closing the nozzle opening. The mass may comprise a refractory material. Alternatively, the mass may comprise a gas-permeable block, and there may be further provided a separate gas supply connection connected to the gas-permeable block.

BRIEF DESCRIPTION OF THE DRAWINGS

Other objects, features and advantages will be apparent from the following detailed description of preferred, but nonlimiting, embodiments of the present invention, with reference to the accompanying drawings, wherein.

DETAILED DESCRIPTION OF THE INVENTION

Figure 1:
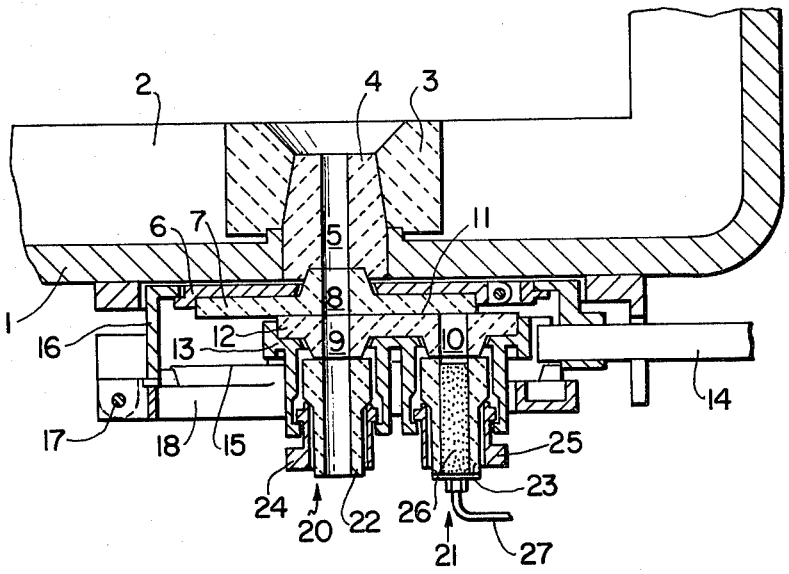
FIG. 1 is a lengthwise cross-section through an improved slide valve in accordance with one embodiment of the present invention and shown installed in the bottom of a metallurgical vessel.

With reference now to FIG. 1 of the drawings, there is illustrated a portion of the bottom of a metallurgical vessel including a bottom metal jacket 1 lined with a fireproof refractory lining 2 having in an outlet region thereof a bottom brick 3. A spout brick 4 is positioned within the bottom brick 3 and has extending therethrough an outlet flow-through opening 5. Such metallurgical vessel construction is conventional, and the present invention is not intended to be specifically limited thereto, inasmuch as the improved slide valve of the present invention is equally applicable to any other type of conventional metallurgical vessel outlet structure.

The slide valve includes a refractory stationary plate 7 fixedly positioned beneath the spout brick 4, and a refractory slide plate 12 mounted beneath the stationary plate for sliding movement with respect thereto between plural positions. In the illustrated embodiment the slide plate 12 is a linearly movable slide plate. However, it is to be understood that the present invention is equally applicable to a rotary slide plate.

Stationary plate 7 has therethrough a flow-through opening 8 aligned with outlet flow-through opening 5 of spout brick 4. Slide plate 12 has therethrough plural flow-through openings adapted to align with the flow-through opening 8 of stationary plate 7 at respective of the plural positions of the slide plate. In the illustrated embodiment the slide plate 12 has therethrough two flow-through openings 9 and 10 . It is to be understood however that the scope of the present invention is equally applicable to slide plates having therethrough more than two flow-through openings.

Stationary plate 7 and slide plate 12 are respectively mounted in metal support members 6 and 13, support member 13 being slidable along a rail 15 which is part of a cover 18 which is openable and closeable by swinging about pivot 17 of a slide housing 16. Cover 18 is tightened in a vertical direction in a conventional mnner, for example by bolts or screws (not shown) in order to tension slide plate 12 against stationary plate 7. It will be understood by those skilled in the art that such tensioning must be tight enough to press sliding surface 11 of slide plate 12 against the stationary plate to prevent leakage but loose enough to permit sliding movement of the slide plate 12.

A plurality of nozzle members are selectively removable mounted adjacent each of the flow-through openings in the slide plate. Thus, in accordance with the illustrated embodiment there are provided two nozzle members 20 and 21. Each nozzle member comprises a refractory member 22, 23 having therethrough a nozzle opening adapted to align with the respective flow-through opening 9, 10 in the slide plate 12. A metal coupling sleeve 24, 25 surrounds the respective refractory member 22, 23 and has exterior shaping to allow coupling to respective portions of a nozzle support member formed on support member 13. Thus, metal coupling sleeves 24, 25 have plug-type connecting elements which act in concert with corresponding elements on member 13 to fasten the refractory members 22, 23 in such a way to produce effective sealing of the joints between the abutting surfaces of the slide plate 12 and the refractory members 22, 23.

In the illustrated embodiment the nozzle member 20 aligned with flow-through opening 9 is designed in the form of an outlet nozzle which is operable to stabilize the flow of metal melt flowing through the slide valve. Thus, the nozzle opening through nozzle member 20 is free and unobstructed.

On the other hand, the nozzle member 21 is in the form of a unique injector nozzle according to the present invention. The exterior configuration of injector nozzle 21 is the same as the outlet nozzle 20. However, the injector nozzle 21 includes means for injecting a supply of gas therethrough. Specifically, a gas-permeable refractory block 26 fills the nozzle opening through refractory member 23, throughout the entire cross-section of the nozzle opening. A gas supply connection 27 is connected to the gas-permeable block 26.

By equipping the slide valve with the outlet nozzle 20 and the injector nozzle 21 shown in FIG. 1, it is possible to ensure trouble-free operation of the slide valve while ensuring operating safety. That is, when the injector nozzle 21 becomes worn, it may readily be replaced while the slide plate 12 is in the position shown in FIG. 1 of the drawings. Alternatively, if outlet nozzle 20 becomes worn, then it may readily be replaced when the slide plate is moved to align flow-through opening 10 with the flow-through opening 8.

Furthermore, in accordance with the present invention a gas may be easily injected through flow-through opening 10 and into the liquid melt outlet to prevent solidification of the melt within the openings 5, 8 and 10. Additionally, injector nozzle 21 may be employed to inject a gas into the melt for the purpose of further metallurgical processing or treatment thereof.

Figure 2:
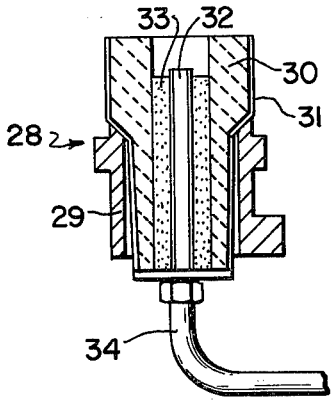
FIG. 2 is an enlarged cross-section of an injector nozzle employable in the slide valve of FIG. 1, but of a second embodiment in accordance with the present invention.

With reference now to FIG. 2 of the drawings, there will be described an injector nozzle 28 suitable for the introduction of liquids and/or solids. Specifically, injector nozzle 28 includes a refractory member 30 and a metal coupling sleeve 29 similar in structure to those discussed above regarding the embodiment of FIG. 1. Additionally, there is shown in FIG. 2 an arrangement whereby a metal lining 31 covers the exterior of the refractory member 30, with the sleeve 29 surrounding the metal lining 31. This construction provides for better exchangeability and handling of the nozzle, and it is to be understood that the metal lining 31 may also be provided in the injector nozzle 21 of FIG. 1.

The injector nozzle 28 has extending into the nozzle opening thereof a tube 32 which is connected to a supply 34 for the introduction of solid and/or liquid material. The tube 32 is held in place within the nozzle opening by means of a mass 33. Mass 33 may be a refractory material which cements the tube 32 in place. Alternatively, mass 33 may be a gas-permeable block, and the injector nozzle 28 may additionally include a gas supply, separate from the solid and/or liquid supply 32, 34, and connected to the gas permeable block.

By the arrangement of the embodiment of FIG. 2, it is possible to inject a liquid and/or solid material through the openings 10, 8 and 5 to achieve any desired treatment of the melt.

It will be apparent that the improved slide valve of the present invention is superior to conventional slide valves allowing for the introduction of components into the melt, since such conventional slide valves provide for gas-permeable materials or gas inlets within the slide plate itself. Thus, repair or replacement of the gas injection structure in known slide valves requires replacement of the slide plate itself. Such disadvantage is entirely overcome in accordance with the present invention wherein only the respective nozzle member or members need be replaced, without replacement of the slide plate.

In accordance with a further features of the present invention, the slide plate may have therein more than two flow-through openings, with various of the flow-through openings having connected thereto separate injector nozzles for the injection of gas material, of liquid material and of solid material. Such embodiment would be particularly applicable to slide plates of the rotary type, without substantially increasing the size of the slide plate.

The improved slide valve according to the present invention is ideal for practical use in various metallurgical operations, since mixing operations needed in crucible metallurgy can be performed in an effective manner, in addition to the ordinary opening, closing and regulating functions required of a slide valve. It will be apparent that in accordance with the present invention there may be provided a great multiplicity of injector nozzles of various internal sizes and configurations, and that such injector nozzles may be readily selectively replaceable at particular flow-through openings of the slide plate.

Although the present invention has been described and illustrated with respect to particular preferred features thereof, it is to be understood that various modifications may be made to such particular features without departing from the scope of the present invention.

What I claim is:

1. A slide valve for the outlet of a metallurgical vessel, said slide valve comprising:

a refractory stationary plate having a flow-through opening and adapted to be fixedly positioned beneath an outlet in a metallurgical vessel;

a refractory slide plate mounted beneath said stationary plate for sliding movement with respect thereto between plural positions, said slide plate having plural flow-through openings adapted to align with said flow-through opening of said stationary plate at respective of said plural positions of said slide plate;

a nozzle support member mounted beneath said slide plate and movable therewith;

a plurality of nozzle members having therethrough nozzle openings, said nozzle members being selectively removably mounted on said nozzle support member for movement therewith at positions with each said nozzle opening being aligned with a respective said flow-through opening of said slide plate;

said nozzle opening of at least a first said nozzle member being free and unobstructed, thereby forming outlet nozzle means for the discharge therethrough of liquid melt; and said nozzle opening of at least a second said nozzle member having therein an injector, thereby forming injector nozzle means for the injection of material therethrough and into the respective said flow-through opening of said slide plate.

2. A slide valve as claimed in claim 1, wherein each said nozzle member comprises a refractory member having the respective said nozzle opening therethrough, and a metal coupling sleeve surrounding said refractory member and adapted to be coupled to said nozzle support member.

3. A slide valve as claimed in claim 2, further comprising a metal lining covering the exterior of said refractory member, said sleeve surrounding said metal lining.

4. A slide valve as claimed in claim 2, wherein all of said nozzle members have identical exterior configurations.

5. A slide valve as claimed in claim 1, wherein said injector comprises a gas-permeable refractory block filling the respective said nozzle opening throughout the entire transverse cross-section thereof, and a gas supply connection connected to said refractory block.

6. A slide valve as claimed in claim 1, wherein said injector comprises a tube for the supply of liquid and/or solid material, said tube extending into the respective said nozzle opening, and a mass cementing said tube within and closing said nozzle opening.

7. A slide valve as claimed in claim 6, wherein said mass is a refractory material.

8. A slide valve as claimed in claim 6, wherein said mass comprises a gas-permeable block, and further comprising a gas supply connection connected to said block.

* * * * *